US007028649B1

(12) United States Patent
Hosaluk et al.

(10) Patent No.: US 7,028,649 B1
(45) Date of Patent: Apr. 18, 2006

(54) HIGH FLOW REED VALVE ASSEMBLY FOR A TWO-CYCLE ENGINE

(75) Inventors: Lawrence J. Hosaluk, Roseau, MN (US); Dan Erickson, Steinbach (CA); Scott E. McKinster, Salol, MN (US)

(73) Assignee: Polaris Industries Inc., Medina, MN (US)

( * ) Notice: Subject to any disclaimer, the term of this patent is extended or adjusted under 35 U.S.C. 154(b) by 96 days.

(21) Appl. No.: 10/793,132

(22) Filed: Mar. 4, 2004

(51) Int. Cl.
*F02B 75/02* (2006.01)

(52) U.S. Cl. ..... 123/73 V; 123/65 V; 137/855; 137/856

(58) Field of Classification Search ..... 123/65 V, 123/73 V; 137/855, 856
See application file for complete search history.

(56) References Cited

U.S. PATENT DOCUMENTS

| | | | | |
|---|---|---|---|---|
| 2,199,307 | A * | 4/1940 | Eichelberg | 137/855 |
| 2,408,056 | A | 9/1946 | Farmer | 251/119 |
| 2,781,777 | A | 2/1957 | Oxnam | 137/525.5 |
| 3,981,276 | A | 9/1976 | Ernest | 123/8.45 |
| 4,395,978 | A | 8/1983 | Boyesen | 123/73 R |
| 4,879,976 | A | 11/1989 | Boyesen | 123/651 |
| 4,905,638 | A * | 3/1990 | Curtis et al. | 123/73 V |
| 4,915,128 | A | 4/1990 | Masserini | 137/512.15 |
| 5,027,754 | A | 7/1991 | Morone | 123/52 MF |
| 5,245,956 | A | 9/1993 | Martin | 123/73 V |
| 5,823,150 | A | 10/1998 | Konakawa | 123/73 V |
| 2003/0209275 | A1 | 11/2003 | Tassinari et al. | 137/855 |

FOREIGN PATENT DOCUMENTS

| | | |
|---|---|---|
| JP | 2-61321 | 3/1990 |
| JP | 3-61610 | 3/1991 |

* cited by examiner

*Primary Examiner*—Noah P. Kamen
(74) *Attorney, Agent, or Firm*—Fredrikson & Byron, P.A.

(57) ABSTRACT

A reed valve assembly in certain embodiments of the present teachings may include one or more of the following features: (a) a W shaped reed cage assembly having at least two reed cages, each reed cage having outer air ports and inner air ports wherein the inner air ports face one another, (b) a plurality of reeds that cover the inner and the outer air ports, the reeds secured to the reed cage assembly, and (c) a center splitter secured between the inner air ports of the reed cages, the center splitter having a shape designed to match the deflected shape of the inner reeds when the inner reeds open.

56 Claims, 7 Drawing Sheets

HIGH FLOW REED VALVE ASSEMBLY FOR A TWO-CYCLE ENGINE

FIELD

The present teachings relates to the field of engine parts. Specifically, the present teachings relate to the field of reed valve assemblies. More specifically, the present teachings are directed at reed valve assemblies for use in two-stroke motors.

BACKGROUND

FIG. 1 is an example of a prior art two-stroke motor reed valve. Reed valve 10 includes a V-shaped base 12, pliable reed petals 14, and stoppers 16. Base 12 is substantially hollow with a plurality of openings (shown with a dotted line) covered by reed petals 14. In operation, air flows into the center of base 12 and through the openings in base 12, pushing reed petals 14 back towards stoppers 16. When the air reverses flow, reed petals 14 press firmly against base 12, covering the openings and substantially impeding airflow through base 12. Reed valves are typically located between an air induction control device, such as a carburetor or a throttle body, and an opening into the crankcase of an engine. However, a common variant of the two-stroke engine has the reed opening in the base of the cylinder instead of in the crankcase.

A limitation with this prior art design is only a limited amount of airflow enters the engine within the space constraints of a typical two row reed valve. As discussed above, traditional two row reed valves have one row of reeds on each side. These reeds only open a certain distance, which is dictated by the differential pressure across the reeds. That is, the differential pressure can only open the reeds to a certain deflection due to resistance of the reeds to stay in a closed position. This provides a limitation to the amount of airflow, which can realistically pass through the reed valve.

Prior reed valve designs have tried to overcome this limitation by adding a second row of reed valves, so that there are four rows of reeds instead of two. FIG. 2 is an image of a prior art four row reed valve assembly similar to those described in U.S. Pat. Publication 2003/0209275 to Tassinari and Japanese Abstract 03-061610A2 to Yoshinori. Reed valve 20 includes a W-shaped base assembly 22, pliable reed petals 24, guards 26, and an inner stopper 28. The design of this reed valve 20 creates a broader opening for allowing passage of air and improved engine performance. Also reed petals 24 against guards 26 do not have to bend as far as reed petals 14 in a traditional reed valve 10 for reed valve 20 to allow more airflow than the traditional reed valve 10 because of the additional volume of airflow allowed past the reed petals 24 against the inner stopper 28. However, these prior art designs are still limited in the amount of volume of airflow allowed past the reed petals due to the length of time the petals are actually open. This is due to the fact that as a reed petal opens towards a stopper there will be air trapped between the stopper and the reed petal. This prevents the reed petal from fully opening until the air is pushed out from behind the petal. The longer the reed petal is not fully opened, the greater the volume of air passing the reed petal is decreased. This is undesirable and limits engine performance.

Another limitation associated with the four-row reed valve design is they are a multi-piece assembly, which requires assembly. For example, these prior art designs typically have a muti-part cage design along with all the other pieces of the assembly. Due to the number of pieces of the assembly and the amount of labor required to assemble, the assembly becomes expensive to produce especially for mass production.

Another limitation with the traditional 2-stroke motor reed valves is durability. A reed petal 14 opens and closes about 133 times per second at 8,000 rpm. The fatigue on the reed petals 14 requires regular replacement of reed petals 14. Further, in a four-row reed design like that of FIG. 2 without a stopper, the inner reeds can be damaged by hitting each other when they open. Prior reed valve designs have attempted to solve this problem by inserting an inner stopper between the inner petals to prevent the inner petals from hitting one another. Typically, these inner stoppers have some arbitrary curved shape to keep the reeds from hitting each other. While these stoppers have been successful at stopping the inner reeds from hitting one another, the reeds do continue to hit the inner stopper, as designed. Since the inner stoppers have an arbitrary curved design, reed petals continue to fail due to the reed petals hitting against the inner stopper in an arbitrary fashion. The arbitrary shape of the stopper also forces the reed to deform to the shape of the stopper rather than its natural shape. This also limits airflow by restricting reed deformation. Therefore a reed valve assembly design is needed that reduces wear on the reed petals.

SUMMARY

A reed valve assembly in certain embodiments of the present teachings may include one or more of the following features: (a) a W shaped reed cage assembly having at least two reed cages, each reed cage having outer air ports and inner air ports wherein the inner air ports face one another, (b) a plurality of reeds that cover the inner and the outer air ports, the reeds secured to the reed cage assembly, and (c) a center splitter secured between the inner air ports of the reed cages, the center splitter having a shape designed to match the deflected shape of the inner reeds when the inner reeds open.

A reed valve assembly in certain embodiments of the present teachings may include one or more of the following features: (a) a reed cage assembly having at least two reed cages, the reed cages having inner and outer air ports, (b) a plurality of reeds that cover the inner and the outer air ports, the reeds secured to the reed cages, and (c) a center splitter secured between the inner air ports of the reed cages, the center splitter having at least one channel.

A two-stroke engine in certain embodiments of the present teachings may include one or more of the following features: (a) a crankcase, (b) a piston, (c) a cylinder, (d) a transfer port (e) a reed cage assembly operably connected to the crankcase, the assembly having at least two reed cages, the reed cages having inner and outer air ports, (f) a plurality of reeds that cover the inner and the outer air ports, the reeds secured to the reed cages, and (g) a center splitter secured between the inner air ports of the reed cages, the center splitter having at least one channel.

A reed valve assembly in certain embodiments of the present teachings may include one or more of the following features: (a) a W shaped reed cage assembly having at least two reed cages, each reed cage having outer air ports and inner air ports wherein the inner air ports face one another, (b) a means secured to the reed cage to cover the inner and the outer air ports, and (c) a means for funneling air trapped between the reeds over the inner air ports and the splitter.

A method for manufacturing a reed valve assembly in certain embodiments of the present teachings may include one or more of the following features: (a) casting a reed cage assembly with at least two reed cages, the reed cages having inner and outer air ports, (b) connecting a reed to the reed cage, the reeds lying over the inner, (c) securing a center splitter between the inner air ports of the reed cages, the splitter having a channel, and (d) securing a reed stopper to the reed cage adjacent to the outer air ports, the reed stoppers having a channel.

DRAWINGS

DETAILED DESCRIPTION OF VARIOUS EMBODIMENTS

Figure 1:
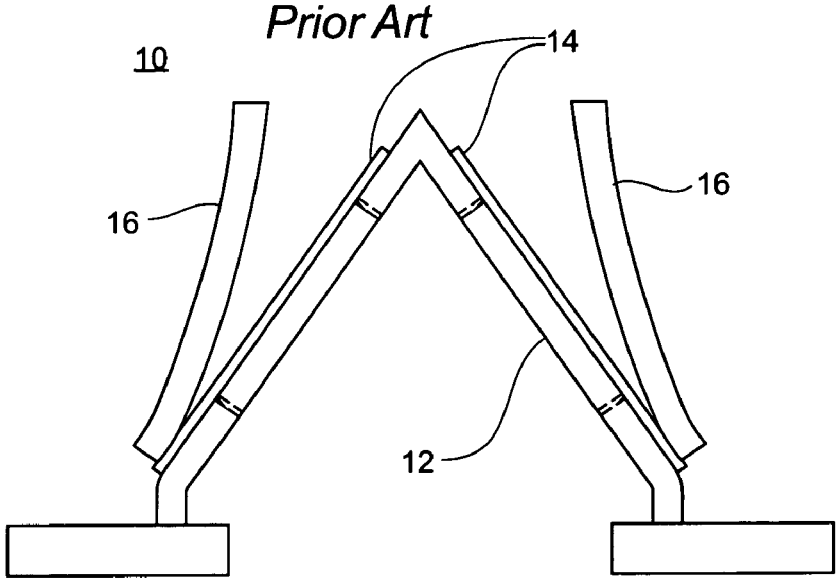
Fig. 1 Prior Art
FIG. 1 shows a cross-sectional diagram of one reed valve in the prior art.
Figure 2:
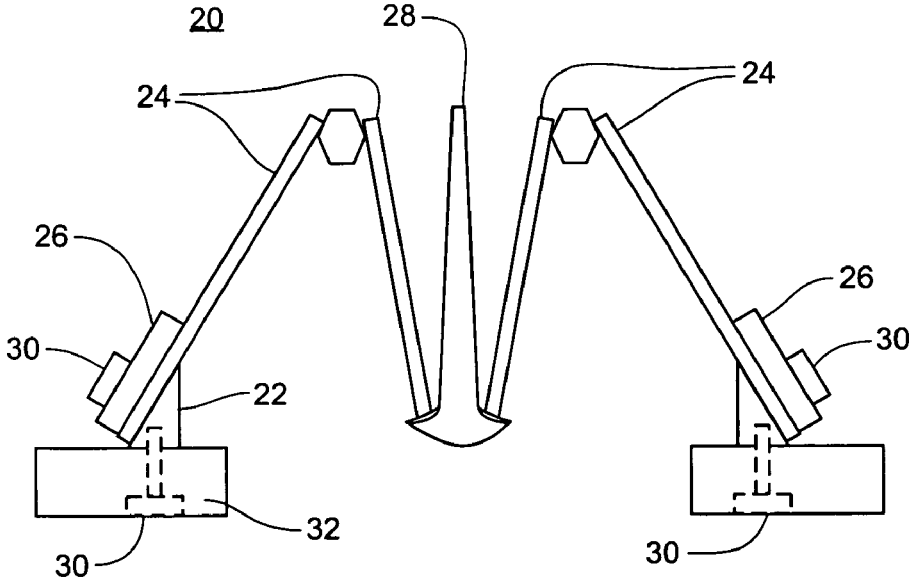
Fig. 2 Prior Art
FIG. 2 shows a cross-sectional diagram of a four-row reed valve assembly in the prior art.

The following discussion is presented to enable a person skilled in the art to make and use the present teachings. Various modifications to the illustrated embodiments will be readily apparent to those skilled in the art, and the generic principles herein may be applied to other embodiments and applications without departing from the present teachings as defined by the appended claims. Thus, the present teachings are not intended to be limited to the embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of the present teachings. Skilled artisans will recognize the examples provided herein have many useful alternatives fall within the scope of the present teachings.

Figure 3:
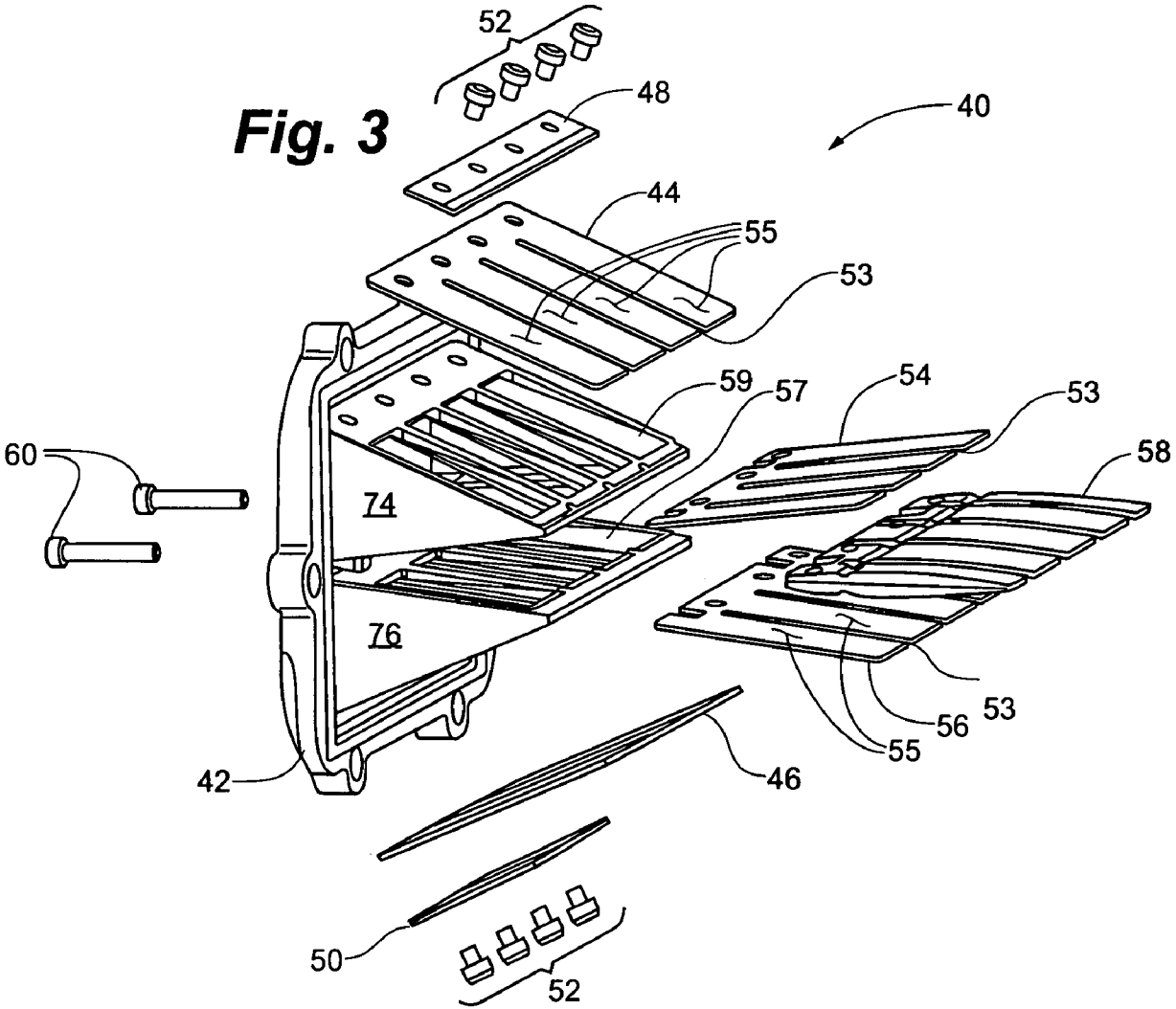
FIG. 3 shows an exploded perspective view of a reed valve assembly from the front side of the assembly according to various embodiments of the present teachings.
Figure 4:
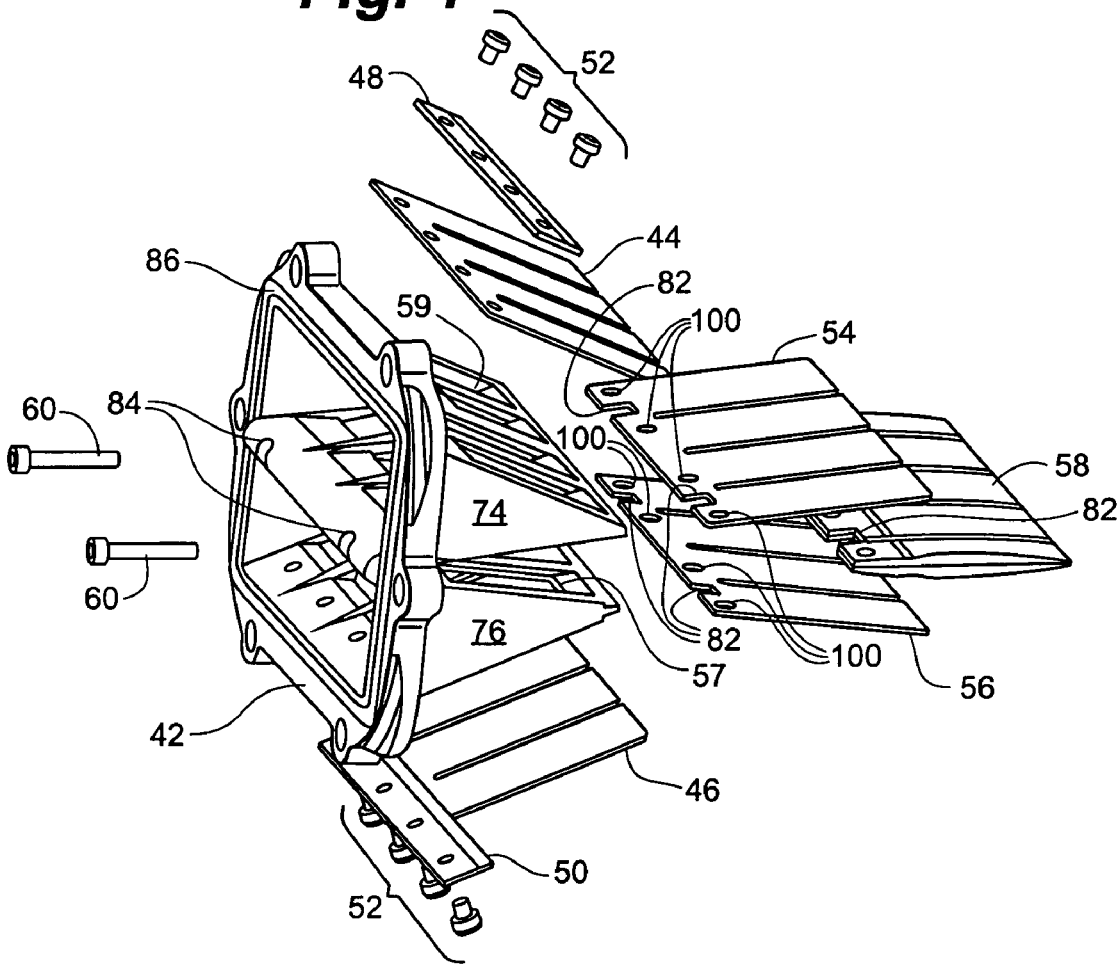
FIG. 4 shows an exploded perspective view of a reed valve assembly from the reed side of the assembly according to various embodiments of the present teachings.
Figure 6:
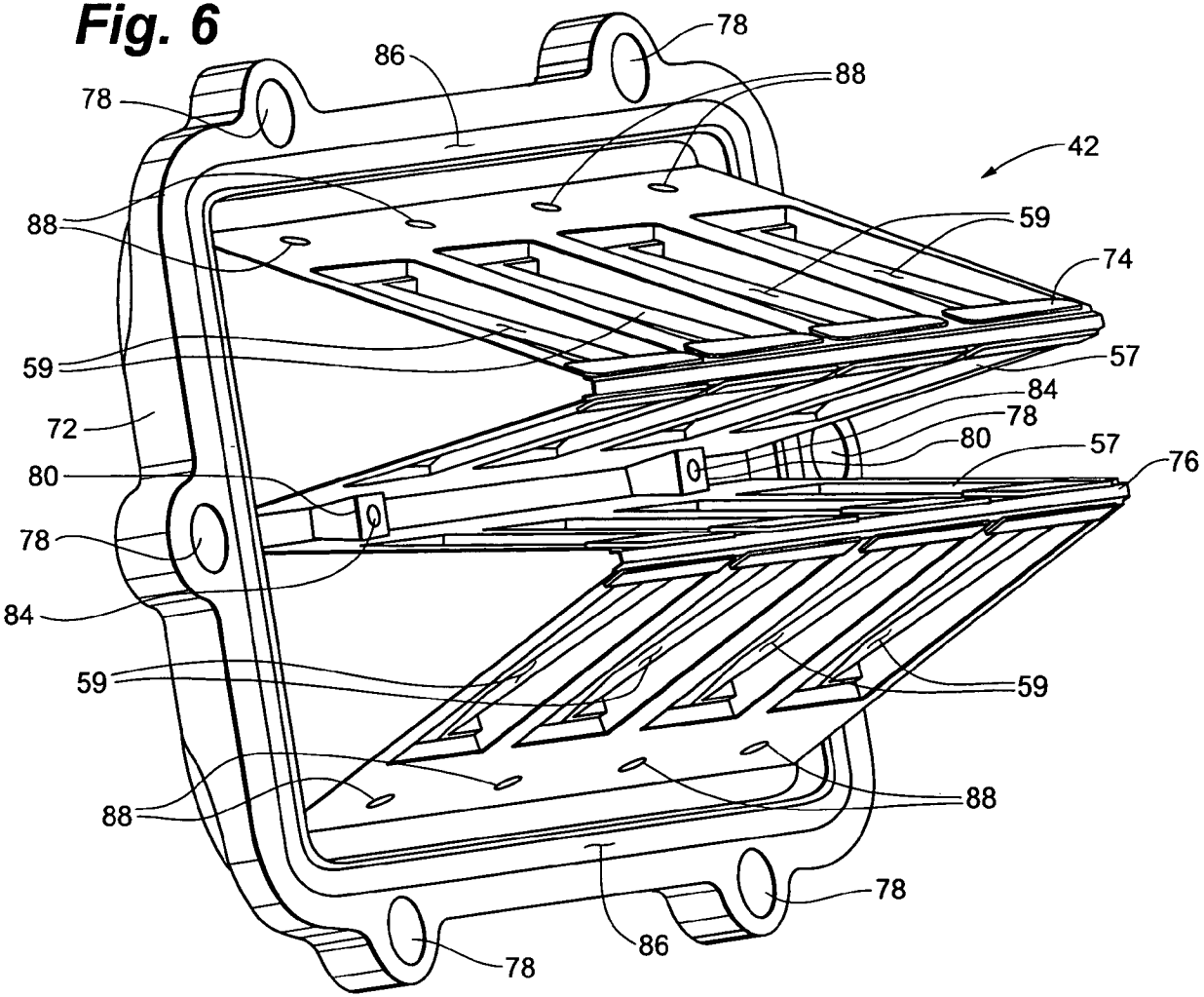
FIG. 6 shows a front profile of a reed cage according to various embodiments of the present teachings.

With reference to FIGS. 3, 4, and 6, exploded perspective front and rear views of a reed valve assembly according to various embodiments of the present teachings are shown. A reed valve assembly 40 in certain embodiments of the present teachings may include a W shaped reed cage assembly 42 having at least two reed cages 74 and 76. Each reed cage 74, 76 having outer air ports 59 and inner air ports 57 wherein inner air ports 57 face one another. Reeds 44, 46, 54, and 56 cover inner 57 and outer air ports 59 to secure reeds 44, 46, 54, and 56 to reed cage assembly 42. A center splitter 58 is secured between inner air ports 57 of reed cages 74 and 76. Center splitter 58 can have a shape designed to match the deflected shape of inner reeds 54 and 56 when inner reeds 54 and 56 open. Outer reeds 44, 46 lay over outer air ports 59 of reed cage assembly 42 and are held in place by outer reed retainers 48, 50 and fastened to cage 42 by fastening screws 52. Inner reeds 54, 56 lay over inner air ports 57 with center splitter 58 located in-between reeds 54, 56. Screws 60 are then inserted through cage 42 and into center splitter 58, which holds reeds 54, 56 in place, as will be described in more detail below. Reeds 44, 46, 54, and 56 can be divided into at least two reed petals 55 separated by slots 53. Each petal can act over one airport 57, 59 in reed cage 42.

A method for manufacturing a reed valve assembly in certain embodiments of the present teachings may include casting a reed cage assembly 40 with at least two reed cages 74 and 76, reed cages 74 and 76 having inner 57 and outer air ports 59. Connecting reeds 44, 46, 54, and 56 to reed cage 42 where the reeds 44, 46, 54, and 56 lie over the inner. Securing a center splitter 58 between inner air ports 57 of reed cages 74 and 76 where splitter 58 can have a channel 90. Securing reed stoppers 112 and 114 to reed cage 42 adjacent to outer air ports 59 where reed stoppers 112 and 114 can have a channel 90.

Figure 5:
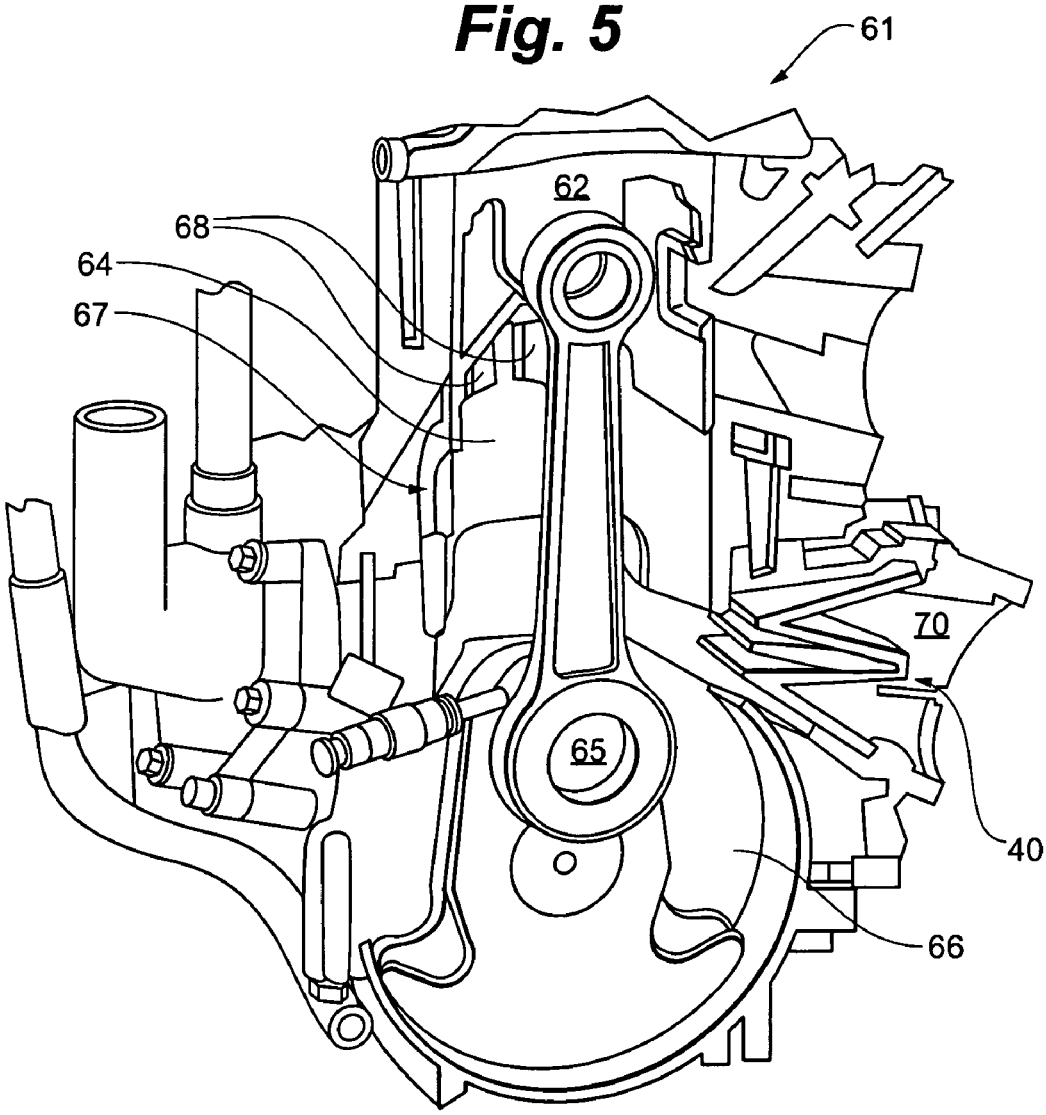
FIG. 5 shows a general environmental view for a reed valve assembly in various embodiments of the present teachings.

FIG. 5 shows a general environmental view of a two-stroke engine in which a reed valve assembly according to any embodiments in which the present teachings may be used. During operation piston 62 in engine 61 moves downward from top dead center of cylinder 64 after firing. This downward motion creates pressure in crankcase 66. Piston 62 is compressing the air underneath piston 62 producing pressure inside crankcase 66 that is greater than atmospheric pressure which forces reeds 44, 46, 54, and 56 to close. As piston 62 continues to move down cylinder 64 it continues to increase the pressure in crankcase 66. As piston 62 passes transfer ports 68 and boost port 67 in the cylinder wall the pressure in crankcase 66 under piston 62 is relieved by air flowing through the transfer ports from below piston 62. Up to this point reeds 44, 46, 54, and 56 have remained closed. As piston 62 reaches bottom dead center it turns around and begins to rise in cylinder 64. As it begins to rise, piston 62 causes a vacuum, which causes the pressure in crankcase 66 to drop below atmospheric pressure. At this point, reeds 44, 46, 54, and 56 begin to open and air or an air-fuel mixture flow into crankcase 66 through induction mount 70. As piston 62 rises further towards top dead center, thus increasing the vacuum even further, reeds 44, 46, 54, and 56 open to their full extent. At a point substantially close to top dead center, the differential pressure is relieved and reeds 44, 46, 54, and 56 begin to close the time varying slightly based upon engine speed. Sometimes, when engine 61 is operating at a high speed air continues to flow through reeds 44, 46, 54, and 56 even after piston 62 passes top dead center and starts down again.

With reference to FIG. 6, front perspective views of a reed cage according to various embodiments of the present teachings are shown. Reed cage 42 can be an integral unit with a base 72 and two reed cages 74, 76. Base 72 has a plurality of fastening apertures 78 which are used to fasten reed cage 42 between an air induction mount 70 connected to an air induction control device, such as a carburetor or a throttle body, and two-stroke engine 61 (FIG. 5). Base 72 has a greater thickness of 8 mm compared to prior reed valves assemblies, however, the base thickness can vary between 5–12 mm. This greater thickness locates the reeds further away from the centerline of engine 61. Simply put, the base's thickness can be chosen to move reeds 44, 46, 54, and 56 either closer or further from the centerline of crankshaft 65, thus manipulating the volume of crankcase 66. The crankcase volume is a parameter that can be used to tune the power-band of a two-stroke engine. Reed valves of the prior art place the reeds as far inward as possible, requiring a separate postproduction spacer to be purchased and installed to increase the volume. The present teachings include a spacer integrally built in base 72. The result is increased engine performance. Each reed cage 74, 76, has four outer air ports 59 and four inner air ports 57, however, it is contemplated the reed cages could have any number of air ports without departing from the present teachings. Air ports 59, 57 allow air to pass from induction mount 70 into crankcase 66 during the upstroke of piston 62 as is discussed in more detail above. Alignment projections 80 are used to align inner reeds 54, 56 and center splitter 58 in the lateral direction during manufacturing. As can be seen alignment projections 80 are raised from cage 42 to receive notches 82 (FIG. 7) of inner reeds 54, 56, and center splitter 58. Then screws 60 are inserted through apertures 84 as shown in FIG. 4 to secure inner reeds 54, 56 and center splitter 58 to cage 42. As illustrated, cage 42 can be one piece cast out of aluminum, however, it is contemplated cage 42 could be made from other materials such as other cast metals, plastic, or composite plastic without departing from the present teachings. Additionally cage 42 has a rubber sealing beads 86 which help create an air tight seal between cage 42 and engine 61 and between cage 42 and induction mount 70. As discussed above, outer reeds 46, 44 are laid over outer air ports 59 and are held in place by outer reed retainers 48, 50 and fastened to cage 42 by fastening screws 52 into screw apertures 88.

Figure 7:
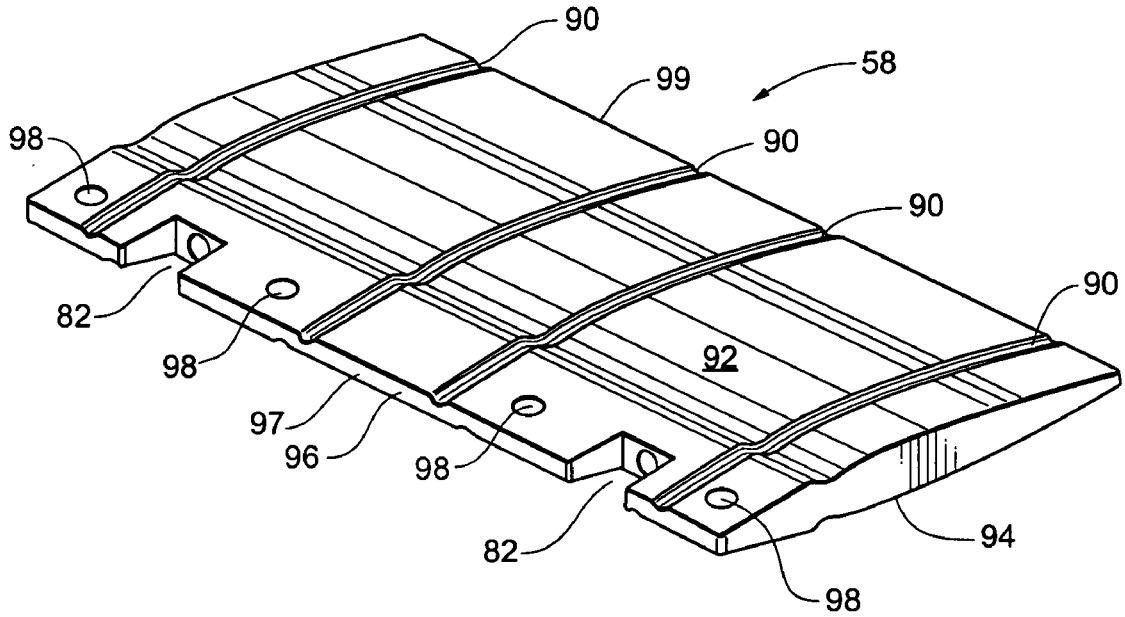
FIG. 7 shows a side rear profile of a center splitter according to various embodiments of the present teachings.

With reference to FIG. 7, a perspective view of a center splitter according to various embodiments of the present teachings are shown. Splitter 58 has channels 90 on a top and bottom surface 92, 94 of splitter 58 extending from a front surface 97 to a rear surface 99 which funnel air trapped between inner reeds 54, 56 and splitter 58 thus preventing air resistance against inner reeds 54, 56 during opening. In the present teachings, splitter 58 can have at least one channel 90 per reed petal 55. Channel 90 can have a width and depth equal to or greater than the thickness of reeds 54, 56. Channel 90 can have a thickness between 4–6 mm. Channel 90 can have most any shape, for example semi-circular, rectangular, square, V-shaped, U-shaped and does not need to fully extend from front surface 97 to rear surface 99. Channel 90 can be equal to the length of reeds 54, 56 which deforms during opening. Without channels 90 inner reeds 54, 56 would more slowly open to a full position (e.g., where the reeds 54, 56 abut splitter 58) due to air trapped between inner reeds 54, 56 and splitter 58. Inner reeds 54, 56 would not be able to fully open until inner reeds 54, 56 were able to push out the trapped air. This delay in fully opening inner reeds 54, 56 reduces the amount of airflow into crankcase 66. The total amount of airflow entering crankcase 66 is a function of the distance inner reeds 54, 56 are open multiplied by the time they are open that amount, integrated over the entire duration of the reed open/reed close event. Therefore, the total amount of airflow entering crankcase 66 can be increased by increasing the distance that inner reeds 54, 56 are open at any given instance or by opening inner reeds 54, 56 quicker. Channels 90 allow inner reeds 54, 56 to open quicker by removing the air between inner reeds 54, 56, and splitter 58. Thus, inner reeds 54, 56 don't necessarily open further, but do open quicker. Channels 90 act similar to slots in a table. If a piece of paper is dropped from a distance over the table the paper will fall quicker because the air underneath the paper can escape via the slots. Likewise channels 90 provide a path for air to escape from between inner reeds 54, 56 and splitter 58 in milliseconds, which is beneficial considering reeds 54, 56 open extremely fast at a high engine speed. The quicker opening of reeds 54, 56 have been found by the inventors to improve engine performance.

Figure 8:
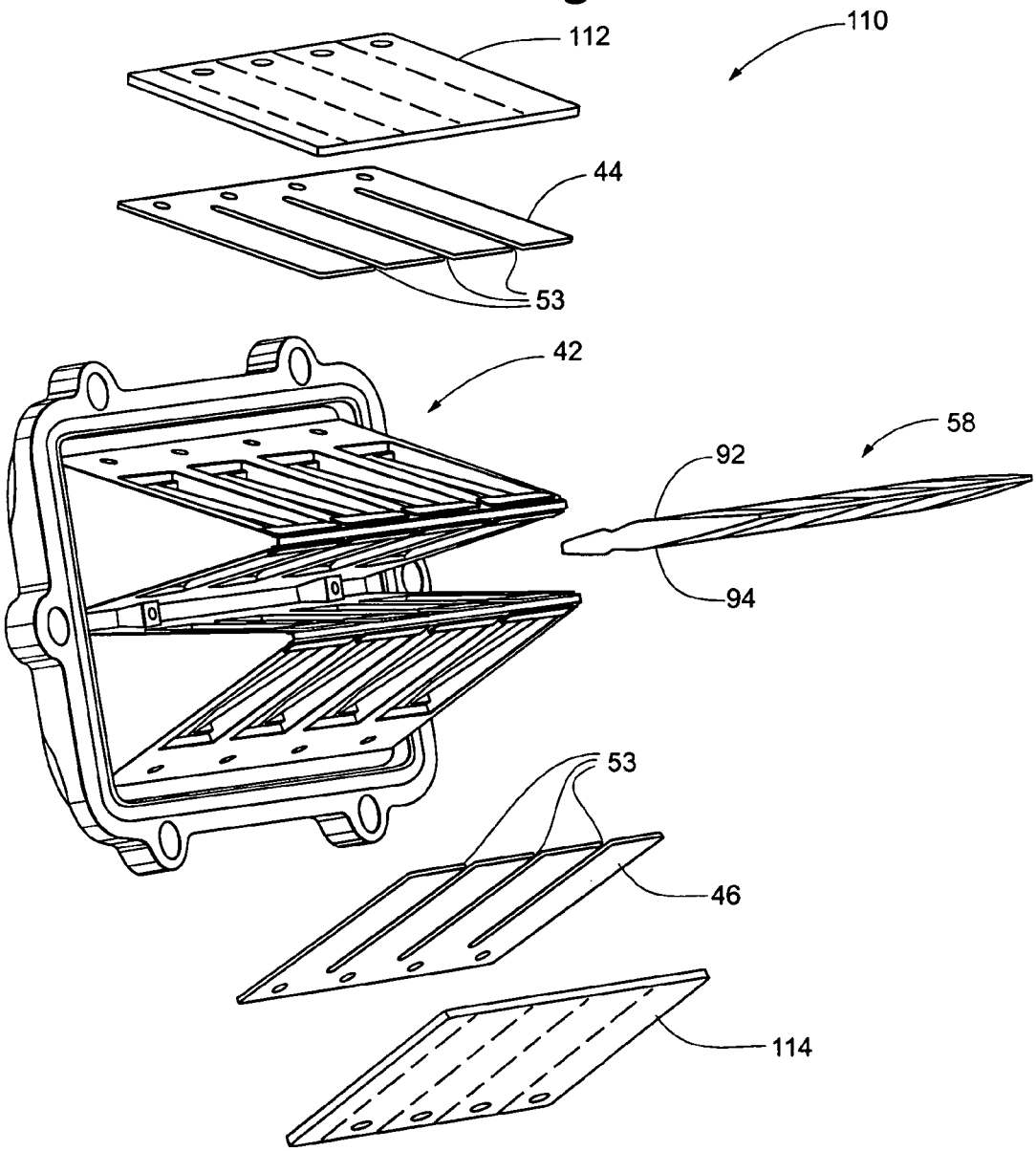
FIG. 8 shows an exploded front side profile of a reed valve assembly according to various embodiments of the present teachings.

With reference to FIG. 8, an exploded front perspective view of a reed valve assembly according to various embodiments of the present teachings are shown. Reed valve assembly 110 has channels 90, shown as dotted lines, on outside reed stoppers 112, 114 similar to splitter 58 to more quickly open outer reeds 44, 46. It is contemplated, use of channels 90 could be extended to any reed-stopping device or be implemented in combination with the reeds to more quickly open the reeds and thus achieve higher engine performance. It is further contemplated splitter 58 or outer reed stoppers 112, 114 could be implemented on any type of reed valve base assembly including a V-shaped base without departing from the present teachings.

Splitter 58 has a unique shape to not only prevent inner reeds 54, 56 from hitting each other during opening, but also to prevent damage to reeds 54, 56 through repeated striking of splitter 58. Unlike prior splitters having an arbitrary design which cause reed failures from repeated contact, splitter 58 has contoured surfaces 92, 94 that are calculated to match the actual deformed deflected shape of inner reeds 54, 56 during opening of inner reeds 54, 56. This allows inner reeds 54, 56 to contact splitter 58 over a larger area. Therefore, the force of the contact between inner reeds 54, 56 and splitter 58 is dispersed over a larger area thus reducing the effect of the force. This design provides increased durability of the reed compared to known reed valve assemblies. The splitter's shape also allows for an increase in airflow into crankcase 66 by matching the splitter shape to the natural deformed shape of reeds 54, 56, which eliminates any part of reeds 54, 56 remaining in the path of the airflow thus blocking any airflow. By having reeds 54, 56 flush against splitter 58 no part of reeds 54, 56 remain in the airflow path thus allowing more air to enter crankcase 66. In various embodiments of the present teachings, the deflection shape of inner reeds 54, 56 are calculated as follows:

$$\text{Deflection} = \left(\frac{w}{120 \cdot E \cdot I \cdot L}\right) \cdot [4 \cdot L^5 - 5 \cdot L^4 \cdot x + x^5]$$

$$\text{Moment of Inertia} = \frac{W \cdot t^3}{12}$$

Where E is the modulus of elasticity, I is the moment of inertia, L is the length of a reed, w is the load, W is the width of a reed, t is the reed thickness, and x is the array length. This equation provides an accurate representation of the deflection shape of inner reeds 54, 56 when the reeds 54, 56 are in a fully open state. Thus, splitter 58 can be manufactured to match the shape of the defected reeds 54, 56 thus creating a greater surface area for reeds 54, 56 to contact splitter 58. With reference to the Table 1 below, the defection in millimeters is shown with a varying length array. For the testing to create the Table below, L=40 mm, t=0.508 mm, W=17.5 mm, w=25N/mm, and E=$2.4\times10^6$ psi. As can be seen from the table below, inner reeds 54, 56 deflected minimally if not at all at front surface 97 where reeds 54, 56 are connected to cage 42. However, moving toward rear surface 99, reeds 54, 56 begin to deflect more and more until maximum deflection at rear surface 99. It's understood the splitter shape could vary with the reed thickness and the material of reeds 54, 56. The algorithm takes into account the thickness, t, and the material via the elastic modulus E. It can be seen from the table below that the defection of reeds 54, 56 is not linear.

TABLE 1

| reed defection in millimeters with a varying length array | |
|---|---|
| Length Array "x" | Deflection |
| 0 | 6.743 |
| 5 | 5.69 |
| 10 | 4.638 |
| 15 | 3.595 |
| 20 | 2.581 |
| 25 | 1.636 |
| 30 | 0.822 |
| 35 | 0.232 |
| 40 | 0 |

With reference again to FIGS. 7 and 4, it can be seen that during the process of tightening splitter 58 to cage 42, inner reeds 54, 56 are secured to cage 42 with one operation and with no additional fasteners. Center splitter 58 has a plurality of spherical projections 98 rising from distal end 96 on surfaces 92, 94 matching up with securing apertures 100 located on inner reeds 54, 56. During manufacturing inner reeds 54, 56 are put in place over inner air ports 57. Then splitter 58 can be then placed between inner reeds 54, 56 aligning with projections 80. As screws 60 are tightened, spherical projections 98 will emerge into apertures 100 essentially mechanically locking inner reeds 54, 56 in place horizontally and vertically.

With reference to the discussion above, high flow reed valve assembly 40 has very few parts including an integral reed cage assembly 42, outer reeds 44, 46, outer reed retainers 48, 50, fastening screws 52, inner reeds 54, 56, center splitter 58, and screws 60. By having a small amount of parts, reed valve assembly 40 is more cost effective to manufacture regarding both materials and labor cost. For example, in prior solutions the cage assembly was two to three separate pieces including two individual cages. In contrast, reed cage 42 can be only one piece wherein each cage can be integrally cast or molded with the base, thus eliminating multiple piece cage assemblies. Thicker base 72 eliminates the need for postproduction reed spacers to provide increased engine performance. In addition, the amount of fasteners required for reed assembly 40 can be reduced by utilizing spherical projections 98 on splitter 58 to mechanically lock inner reeds 54, 56 in place. Therefore, the integral design of cage 42 and the mechanical locking aspect of splitter 58 reduce the amount of parts of reed assembly 40 and thus reduces the amount of labor required to put reed assembly 40 together, thus creating an inexpensive reed valve assembly to produce.

With reference again to FIG. 5, as piston 62 begins to rise from bottom dead center causing the pressure in crankcase 66 to drop below atmospheric pressure, reeds 44, 46, 54, and 56 begin to open. Inner reeds 54, 56 open quickly as air is pushed out of channels 90 and within milliseconds reeds 54, 56 are resting against splitter 58. In comparison to prior solutions, a greater amount of air or an air-fuel mixture flow into crankcase 66 through induction mount 70 providing greater engine performance. At a point along the up stroke returning to top dead center, the differential pressure is relieved and reeds 44, 46, 54, and 56 begin to close.

It will be appreciated the present teachings can take many forms and embodiments. The true essence and spirit of this invention are defined in the appended claims, and it is not intended the embodiments of the present teachings presented herein should limit the scope thereof.

What is claimed is:

1. A reed valve assembly comprising:

a reed cage assembly having at least two reed cages, the reed cages having inner and outer air ports;

a plurality of reeds that cover the inner and the outer air ports, the reeds secured to the reed cages; and a center splitter secured between the inner air ports of the reed cages, the center splitter having at least one channel which traverses the splitter parallel to airflow.

2. The reed valve assembly of claim 1, wherein the center splitter has a plurality of channels wherein at least one channel is located on a top surface of the splitter and at least one channel is located on a bottom surface of the splitter.

3. The reed valve assembly of claim 2, wherein the channels extend from a front surface to a rear surface.

4. The reed valve assembly of claim 1, wherein the channels funnel air trapped between the reeds over the inner air ports and the splitter to reduce air resistance between the reeds over the inner air ports and the splitter.

5. The reed valve assembly of claim 4, wherein the reduced air resistance increases the amount of airflow into an engine crankcase.

6. The reed valve assembly of claim 5, wherein the reduced air resistance allows the reeds to open quickly.

7. The reed valve assembly of claim 1, wherein the reeds have at least one reed petal.

8. The reed valve assembly of claim 7, wherein the splitter has at least one channel associated with each reed petal.

9. The reed valve assembly of claim 1, wherein the channels have a width and depth equal to or greater than the thickness of the reeds.

10. The reed valve assembly of claim 1, wherein channel has a rectangular shape.

11. The reed valve assembly of claim 1, wherein the channel has a length equal to a portion of the reeds that deforms when the reeds are at a maximum deflected state.

12. A reed valve assembly comprising:

a W shaped reed cage assembly having at least two reed cages, each reed cage having outer air ports and inner air ports wherein the inner air ports face one another;

a plurality of reeds that cover the inner and the outer air ports, the reeds secured to the reed cage assembly; and a center splitter secured between the inner air ports of the reed cages, the center splitter having a shape designed to match the deflected shape of the inner reeds, the center splitter having at least one channel.

13. The reed valve assembly of claim 12, wherein the channels are on both surfaces of the splitter to funnel air trapped between the inner reeds and the splitter during opening of the inner reeds.

14. The reed valve assembly of claim 13, wherein the splitter reduces air resistivity between the inner reeds and the splitter.

15. The reed valve assembly of claim 12, wherein contoured surfaces of the splitter provides a larger contact surface area for the inner reeds during opening.

16. The reed valve assembly of claim 15, wherein the contoured surfaces of the splitter provide increased durability.

17. The reed valve assembly of claim 16, wherein the contoured surfaces of the splitter are calculated using an algorithm that provides an accurate representation of the deflection of the inner reeds.

18. The reed valve assembly of 16, wherein the splitter is designed from an algorithm to match the shape of the defected inner reed to create a greater surface area for the inner reeds to contact the splitter.

19. The reed valve assembly of claim 12, wherein the splitter further comprises at least one spherical projection on the contoured surface located near a distal end.

20. The reed valve assembly of claim 19, wherein the spherical projection aligns with a securing aperture on the inner reeds.

21. The reed valve assembly of claim 20, wherein when the splitter is secured to the reed cage assembly the spherical projection emerges into the securing aperture to mechanically lock the inner reed in place horizontally and vertically.

22. A two-stroke engine comprising:

a crankcase, a cylinder operatively coupled to the crankcase, a piston located in the cylinder, a transfer port coupled to the cylinder;

a reed cage assembly operably connected to the crankcase, the assembly having at least two reed cages, the reed cages having inner and outer air ports;

a plurality of reeds that cover the inner and the outer air ports, the reeds secured to the reed cages; and a center splitter secured between the inner air ports of the reed cages, the center splitter having at least one channel traversing parallel to reed cage airflow.

23. The two-stroke engine of claim 22, wherein the channels are located on a top surface and a bottom surface of the splitter.

24. The two-stroke engine of claim 23, wherein the channels extend from a front surface to a rear surface.

25. The two-stroke engine of claim 22, wherein the channels funnel air trapped between the reeds over the inner air ports and the splitter to reduce air resistance between the reeds over the inner air ports and the splitter.

26. The two-stroke engine of claim 25, wherein the reduced air resistance increases the amount of airflow into an engine crankcase.

27. The two-stroke engine of claim 26, wherein the reduced air resistance allows the reeds to open quickly.

28. The two-stroke engine of claim 22, wherein the reeds have at least one reed petal.

29. The two-stroke engine of claim 28, wherein the splitter has at least one channel associated with each reed petal.

30. The two-stroke engine of claim 22, wherein the channels have a width and depth equal to or greater than the thickness of the reeds.

31. The two-stroke engine of claim 23, wherein channel has a rectangular shape.

32. The two-stroke engine of claim 22, wherein the channel has a length equal a maximum deflection of the reeds which deforms during opening.

33. A reed valve assembly comprising:

a W shaped reed cage assembly having at least two reed cages, each reed cage having outer air ports and inner air ports wherein the inner air ports face one another;

means secured to the reed cage for covering the inner and the outer air ports; and at least one channel for funneling air trapped between the reeds over the inner air ports and a center splitter, the at least one channel running parallel to reed cage airflow.

34. The reed valve assembly of claim 33, further comprising the center splitter secured between the inner air ports of the reed cages.

35. The reed valve assembly of claim 34, wherein the center splitter has a shape designed to match the maximum deflected shape of the inner reeds when the inner reeds open.

36. The reed valve assembly of claim 35, wherein the channels are on a top and bottom surface of the splitter to funnel air trapped between the inner reeds and the splitter during opening of the inner reeds.

37. The reed valve assembly of claim 36, wherein the channels reduce air resistivity between the inner reeds and the splitter.

38. The reed valve assembly of claim 35, wherein contoured surfaces of the splitter provide a larger contact surface area for the inner reeds during opening.

39. The reed valve assembly of claim 38, wherein the contoured surfaces of the splitter provide increased durability.

40. The reed valve assembly of claim 39, wherein the contoured surfaces of the splitter are calculated using an algorithm that provides an accurate representation of the deflection of the inner reeds when they open.

41. The reed valve assembly of 35, wherein the splitter is designed from an algorithm to match the shape of the defected inner reed to create a greater surface area for the inner reeds to contact the splitter.

42. The reed valve assembly of claim 35, wherein the splitter further comprises at least one spherical projection on the contoured surface located near a distal end.

43. The reed valve assembly of claim 42, wherein the spherical projection aligns with a securing aperture on the inner reeds.

44. The reed valve assembly of claim 33, wherein the means for funneling are channels located on a top surface and a bottom surface of a splitter.

45. A method for manufacturing a reed valve assembly comprising the steps of:

casting a reed cage assembly with at least two reed cages, the reed cages having inner and outer air ports;

connecting a reed to the reed cage, the reed lying over the inner port; and securing a center splitter between the inner air ports of the reed cages, the splitter having a channel extending parallel to reed cage airflow.

46. The method of claim 45, further comprising the step of securing a reed stopper to the reed cage adjacent to the outer air ports, the reed stoppers having a channel.

47. The method of claim 45, wherein the channels are located on a top surface and a bottom surface of the splitter.

48. The method of claim 47, wherein the channels extend from a front surface to a rear surface.

49. The method of claim 45, wherein the channels funnel air trapped between the reeds over the inner air ports and the splitter to reduce air resistance between the reeds over the inner air ports and the splitter.

50. The method of claim 45, wherein the reeds have at least one reed petal.

51. The method of claim 50, wherein the splitter has at least one channel associated with each reed petal.

52. The method of claim 45, wherein the channels have a width and depth equal to or greater than the thickness of the reeds.

53. The method of claim 45, wherein channel has a rectangular shape.

54. The method of claim 45, wherein the channel has a length equal to a maximum deflection of the reeds which deforms during opening.

55. The method of claim 49, wherein the reduced air resistance increases the amount of airflow into an engine crankcase.

56. The method of claim 55, wherein the reduced air resistance allows the reeds to open quickly.

* * * * *